United States Patent [19]

Bruels

[11] Patent Number: 5,034,581

[45] Date of Patent: Jul. 23, 1991

[54] PNEUMATIC-ELECTRIC SWITCH APPARATUS WITH LOCK-OUT FEATURE

[76] Inventor: John F. Bruels, 806 S. Riverside Dr., P.O. Box 1133, Edgewater, Fla. 32132

[21] Appl. No.: 520,403

[22] Filed: May 8, 1990

[51] Int. Cl.[5] ..... H01H 31/24; H01H 31/26

[52] U.S. Cl. ..... 200/81.4; 200/81.5; 200/81 H

[58] Field of Search ..... 200/81.4, 81.5, 81 R, 200/81 H

[56] References Cited

U.S. PATENT DOCUMENTS 3,845,258 10/1974 Bruels ..... 200/81.4

*Primary Examiner*—Harold Broome

*Attorney, Agent, or Firm*—J. Gibson Semmes

[57] ABSTRACT

An apparatus comprising a plurality of electric switches, pneumatic actuators for the switches, assemblies for preventing inadvertent actuation of one or more switches and supports for the elements of the assemblies in coactive relation to each other, in such a way as to prevent eventual binding of the spring arm retainer. This apparatus further eliminates the need for molding of the retainer plate or the separate molding of the supports leading to a reduction in cost and assembly time.

2 Claims, 1 Drawing Sheet

PNEUMATIC-ELECTRIC SWITCH APPARATUS WITH LOCK-OUT FEATURE

RELATED APPLICATIONS

Ser. No. 359,603 filed May 11, 1973, now U.S. Pat. No. 3,845,258 issued Oct. 29, 1974.

BACKGROUND OF THE INVENTION

This invention relates to the art of remotely actuable switching systems comprising low-force snap switches and pneumatic actuators, and including structure for preventing actuation of one or more switches. The invention finds particular application in explosive atmospheres where sparking in conventional switches could prove dangerous and in situations where the operator of the switch may be particularly sensitive to electric shocks, as in electrically adjustable hospital beds.

DESCRIPTION OF THE PRIOR ART

Numerous pneumatically actuated electric switch systems have been suggested in the past. U.S. Pat. No. 2,838,629 to Panzenhagen shows a remotely controlled switch in which pressure exerted on a collapsible hand bulb is transmitted through a tube to a bellows which expands to actuate a piston which closes the switch. No provision is made for the means for preventing actuation of the switch in the manner of this invention. U.S. Pat. No. 2,875,291 to Armstrong et al. shows a pneumatically operated switch in which air movement causes a ball or piston to move and close the switch circuit. A shield on the squeeze bulb prevents some types of inadvertent actuation of the device; however, the unique mounting structure and actuation preventor of this invention are not shown. U.S. Pat. No. 2,080,720 to Downs et al. shows a remote control switch operating device in which manually displaceable pistons force liquid through tubes to displace other pistons which, in turn, function to close the electrical switches. Although ganged switches and their actuators are shown, the simple structure of this invention and its actuation preventing means are not suggested.

U.S. Pat. No. 3,174,161 to Black shows a known hospital bed structure in which the structure of this invention would find particular utility. The bed is adjustable by the patient using a pendant placed nearby which includes rather conventional electrical switches connected to motors for raising and lowering the entire bed, the head or the foot of the bed. Although means are provided for electrically preventing actuation of the head and foot elevating positions, no disclosure is made of the simple mechanical apparatus of this invention.

U.S. Pat. No. 3,187,136 to Corder et al. shows a multiple pressure switch construction in which individual switches respond to different magnitudes of pressure acting on a common diaphragm; however, no means for preventing inadvertent actuation in the manner of this invention is disclosed. Similarly, U.S. Pat. No. 3,631,389 to Elliott shows a hydraulically actuated switch assembly which fails to include the unique means for preventing actuation as in this invention. My prior U.S. Pat. No. 3,845,258 addresses the problem and this is an improvement thereon.

SUMMARY OF THE INVENTION

An objective of this invention is to provide a simple, easily manufactured combination of pneumatic actuator, electrical switch and nonelectrical means for preventing actuation. To accomplish this end the following are provided: a base plate, a means for supporting a plurality of pneumatic actuators, a plurality of low-force snap switches having their actuating arms disposed in proximity to the pneumatic actuators and plural assemblies located in the path of movement of the actuating arms for selectively preventing their movement when the pneumatic actuators may be activated.

DESCRIPTION OF THE PREFERRED EMBODIMENT

Figure 1:
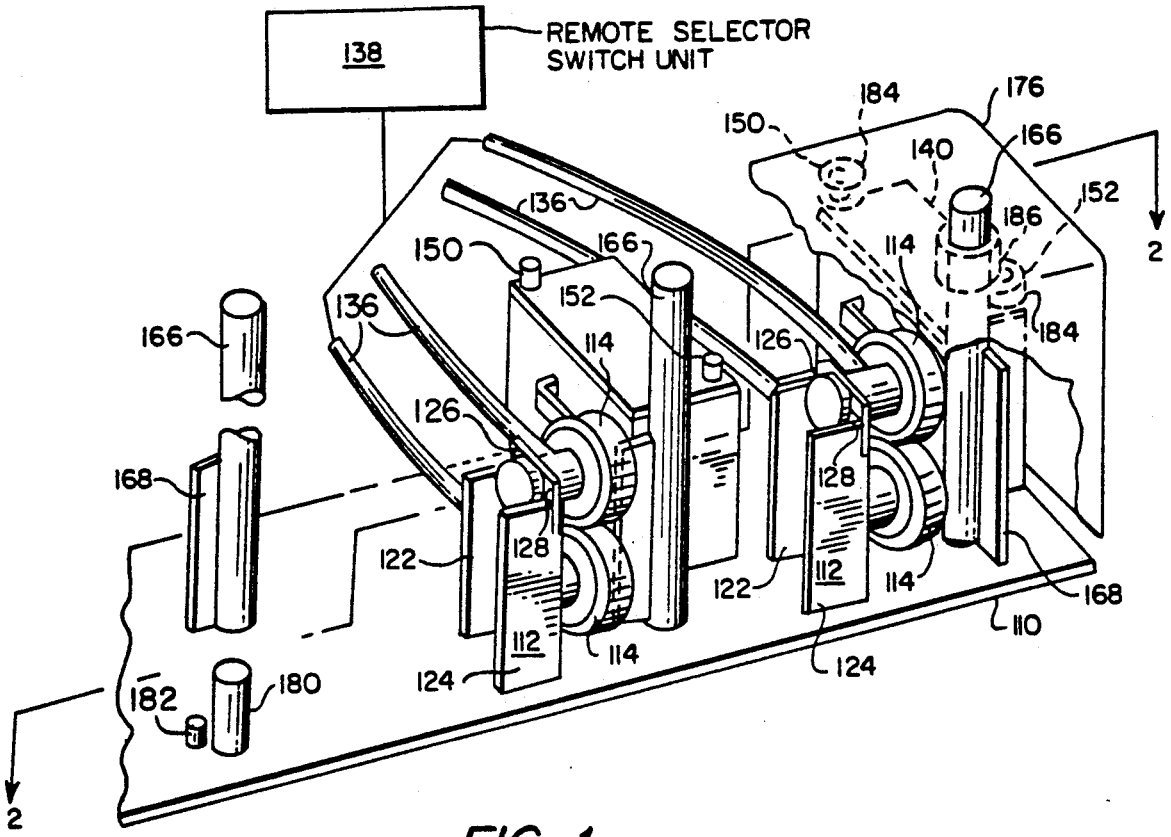
FIG. 1 shows a perspective view of the invention, partially exploded.

There follows a detailed description of the invention, reference being had to the drawing in which like numerals depict like elements of structure in the figures of the drawings.

In the FIG. 1 perspective view of the invention, most elements of the invention except the switches, screws and other fasteners may be made of hard rubber or high impact plastic which facilitates their manufacture by well-known molding techniques and in their assembly common glues are employed. .

Base plate 110, of generally rectangular configuration, is provided along the forward edge with a plurality of in-line stanchions 112 which support pneumatic actuators 114 (similar to those shown in U.S.Pat. No. 3,845,258, or other such actuators). Each stanchion 112 is molded as in integral part of base plate 110. Extending integral with and upwardly from base plate 110 are actuator supports, which comprise separated parallel wall portions 122 and 124 oppositely facing wall portions 126 and 128 respectively. The wall portions with 122 and 126 on one side and 124 and 128 on the other define stanchion slot 130. See FIG. 2.

Pneumatic actuators 114 include a base section 132 having a portion 134 of reduced diameter, somewhat smaller than the width of stanchion slot 130 and somewhat wider than the thickness of opposite facing wall portions 126 and 128. In this manner, a plurality of pneumatic actuators 114 may be stacked in each stanchion 112 as shown. Tubes 136 extend from each pneumatic actuator 114 to a remote pneumatic selector switch unit 138.

Spaced toward the opposite and rearward edge of base plate 110 from the stanchions 112, are low force snap switches 140 of a type well known in the art. The switching elements are located within housing 142 and are actuated by finger 144 extending therefrom into contact with elongated spring arm 146. Switches 140 are located such that end 148 of spring arm 146 lies in light contact with pneumatic actuator 114, prior to actuation thereof. When the operator at unit 138 actuates pneumatic actuator 114, the actuator deflects spring arm 146, FIG. 2, and actuates associated switch 140. Switches such as the common 3TMT18-4 have been found to be suitable for the invention, and may be stacked, with appropriate spacers (not shown), on posts 150 and 152, which are attached to base plate 110.

Aligned approximately with the center of stanchion slot 130 and spaced therefrom are stanchion support 180 and lock stop 182 both being an integral part of base 110 for rendering selective switches 140 inoperable. Preventor lock shaft 166 is hollow to enable a loose fit over stanchion support 180. Spring arm 146 of switch 140 is locked into position by a reversed indent inwardly adjacent end 148 thereof when the lock shaft 166 may have been rotated until spring arm retainer 168 comes to rest against lock stop 182.

In use, the entire assembly is enclosed within a housing 176, shown in phantom, through the upper surface of which extend the preventor lock shafts 166. If the device of the invention is applied to a hospital bed such as shown in Black, previously discussed, one, two or three pairs of pneumatic actuators and switches could be used as desired, depending upon the existing adjustability features of a particular hospital bed.

Figure 2:
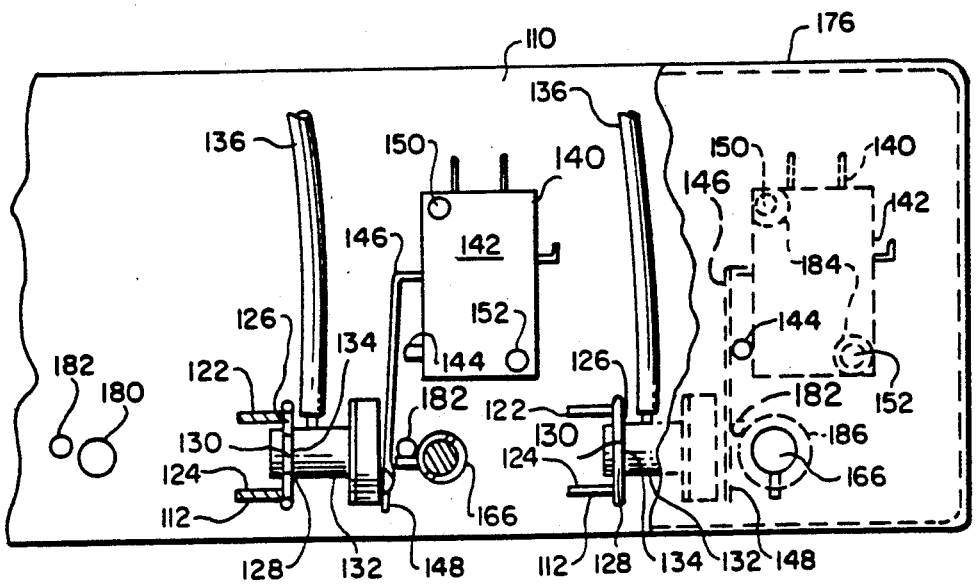
FIG. 2 shows a top plan view, partially in section, taken along line 2—2 of FIG. 1.

In FIG. 2, the effect of the spring arm retainer 168 is shown. In one mode retainer 168 has been rotated into contact with spring arm 146 passing over its reversed indent, adjacent end 148 thereof to retain it from moving under the action of its pneumatic actuator 114. In another mode, retainer 168 has been rotated out of contact with its spring arm 146, thereby permitting its pneumatic actuator 114 to distend as shown and move spring arm 146 to actuate switch 140. Housing 176 and its contents would be placed out of reach of the patient where the appropriate spring arm retainers may be set to permit the patient to adjust the bed.

I claim:

1. In a fluid pressure actuated electrical switching apparatus having a base plate:

A) a switch on the base plate having:
   i. a mounting support; and
   ii. an elongated resilient arm extending therefrom for actuation of said switch;

B) an expandible fluid pressure actuator adjacent the arm to displace said resilient arm for actuation of said switch, said actuator including:
   i. a cylindrical base section having in extension thereof a portion of reduced diameter, intermediate the ends thereof;

C) a support for said actuator, including:
   i. horizontally spaced upstanding walls rising from the base plate, defining therebetween a vertical slot having a width less than the diameter of said cylindrical base section of said actuator and greater than the reduced diameter portion thereof;
   ii. said reduced diameter portion of said actuator being engaged in said support vertical slot, mounting and supporting said actuator in operable juxtaposition to said arm for actuation therethrough of said switch upon operation of said actuator; and D) stop means disposed adjacent said switch arm and having selective active and inactive positions operable upon one or the other of said positions to thereby selectively control operation of said switch, said stop means including:
   i. a rotatably mounted vertical hollow shaft positioned proximate said arm, said shaft defining a radial spring arm retainer thereon;
   ii. a support stanchion upon the base plate and beneath said shaft permitting limited rotation thereof until the radial spring arm retainer on said shaft comes to rest and
   iii. a stop mounted upon the base plate and in juxtaposition to the stanchion to prevent rotation of the shaft in a given direction, by contact of the radial spring arm retainer of the shaft with the stop.

2. Apparatus as claimed in claim 1, wherein said shaft fits loosely over said support stanchion and wherein the resilient arm defines a reversed indent inwardly adjacent the free end thereof, a portion of said spring arm retainer on said shaft being selectively engaged in a lock position when rotated such that said radial extension may reside adjacent to the said reversed indent of the resilient arm for locking same against switch actuation.

* * * * *